US006485035B1

(12) United States Patent
Laughlin et al.

(10) Patent No.: US 6,485,035 B1
(45) Date of Patent: Nov. 26, 2002

(54) BINDING BASEPLATE FOR A GLIDING BOARD

(75) Inventors: James Laughlin, Burlington; Ryan Coulter, Morrisville, both of VT (US)

(73) Assignee: The Burton Corporation, Burlington, VT (US)

( * ) Notice: Subject to any disclaimer, the term of this patent is extended or adjusted under 35 U.S.C. 154(b) by 0 days.

(21) Appl. No.: 09/560,856

(22) Filed: Apr. 28, 2000

(51) Int. Cl.[7] ..... A63C 5/07

(52) U.S. Cl. ..... 280/14.21; 280/602; 280/618; 280/619

(58) Field of Search ..... 280/617, 618, 280/14.21, 14.22, 11.36, 602, 619, 623

(56) References Cited

U.S. PATENT DOCUMENTS

| | | | |
|---|---|---|---|
| 3,538,627 | A | 11/1970 | Labat-Camy |
| 3,812,602 | A | 5/1974 | Gertsch et al. |
| 3,854,743 | A | 12/1974 | Hansen |
| 4,162,089 | A | 7/1979 | Alber |
| 4,652,007 | A | 3/1987 | Dennis |
| 4,741,550 | A | 5/1988 | Dennis |
| 4,772,041 | A | 9/1988 | Klosterman |
| 4,964,649 | A | 10/1990 | Chamberlin |
| RE33,544 | E | 2/1991 | Dennis |
| 5,172,924 | A | 12/1992 | Barci |
| 5,199,735 | A | 4/1993 | Tonel |
| 5,505,477 | A | 4/1996 | Turner et al. |
| 5,549,310 | A | 8/1996 | Meibock et al. |
| 5,577,756 | A | 11/1996 | Caron |
| 5,624,291 | A | 4/1997 | McClaskey |
| 5,679,039 | A | 10/1997 | Robles |
| 5,690,350 | A | 11/1997 | Turner et al. |
| 5,713,587 | A | 2/1998 | Morrow et al. |
| 5,722,681 | A | 3/1998 | Merino et al. |
| 5,743,551 | A | 4/1998 | Goud et al. |
| 5,758,895 | A | 6/1998 | Bumgarner |
| 5,769,446 | A | 6/1998 | Borsoi |
| 5,855,390 | A | 1/1999 | Hassell |
| 5,879,019 | A | 3/1999 | Mantel |
| 5,901,975 | A | 5/1999 | Phipps |
| 5,909,886 | A | 6/1999 | Tugutaka et al. |
| 5,909,894 | A | 6/1999 | Meader et al. |
| 5,941,554 | A | 8/1999 | Bourdeau |
| 5,967,531 | A | 10/1999 | Saillet |
| 5,971,407 | A | 10/1999 | Zemke et al. |
| 5,984,343 | A | 11/1999 | Longoni et al. |

(List continued on next page.)

FOREIGN PATENT DOCUMENTS

| | | | |
|---|---|---|---|
| DE | 197 10 436 A1 | 9/1998 | ..... A63C/9/00 |
| EP | 0 692 286 B1 | 1/1996 | ..... A63C/9/085 |

(List continued on next page.)

OTHER PUBLICATIONS

International Search Report for Japanese Application No. 2545/2001 dated Sep. 20, 2001, with translation.

*Primary Examiner*—Michael Mar
(74) *Attorney, Agent, or Firm*—Wolf, Greenfield & Sacks, P.C.

(57) ABSTRACT

A baseplate for binding a foot to a board, particularly suitable for application as a snowboard binding baseplate, maybe tuned to provide a certain level and/or balance of one or more performance properties including, but not limited to power transmission, responsiveness, feel, and comfort. The binding baseplate may include localized regions of varying stiffness to provide a specific performance property. Consequently, the binding baseplate may include a specific stiffness characteristic at a location where the boot engagement members are mounted, providing a desired response of the binding baseplate to forces that may be generated by the rider during turns, landing jumps, and otherwise during riding.

39 Claims, 2 Drawing Sheets

U.S. PATENT DOCUMENTS

| | | | |
|---|---|---|---|
| 6,010,138 | A | 1/2000 | Bobrowicz et al. |
| 6,027,136 | A | 2/2000 | Phillips |
| 6,082,026 | A | 7/2000 | Sand et al. |
| 6,199,893 | B1 | 3/2001 | Fumagalli |
| 6,199,983 | B1 | 3/2001 | Fumagalli |
| 6,257,997 | B1 | 7/2001 | Doble et al. |

FOREIGN PATENT DOCUMENTS

| | | | |
|---|---|---|---|
| EP | 0824942 | 2/1998 | |
| JP | 10076040 | 2/1998 | |
| JP | 11206952 | 8/1999 | |
| JP | 3070043 | 7/2000 | |
| JP | 2000-140188 | 3/2001 | |
| WO | WO 00/21621 | 4/2000 | ..... A63C/9/08 |

BINDING BASEPLATE FOR A GLIDING BOARD

FIELD OF THE INVENTION

The present invention relates generally to a binding baseplate for a gliding board and, more particularly, to a snowboard binding baseplate.

BACKGROUND OF THE INVENTION

Specially configured boards for gliding along a terrain are known, such as snowboards, snow skis, water skis, wake boards, surf boards, skate boards and the like. For purposes of this patent, "gliding board" will refer generally to any of the foregoing boards as well as to other board-type devices which allow a rider to traverse a surface. For ease of understanding, however, and without limiting the scope of the invention, the inventive binding baseplate for a gliding board to which this patent is addressed is discussed below particularly in connection with a snowboard. However, it should be appreciated that the present invention is not limited in this respect, and that the aspects of the present invention described below can be used in association with other types of gliding boards.

Snowboard binding systems used with soft snowboard boots are typically one of two general types. A first type, known as a tray binding, typically includes a baseplate adapted to receive a snowboard boot, an upright member called a "highback" (also known as a "lowback" and a "SKYBACK") that is mounted at the rear of the binding and that acts as a lever to conduct forces induced by the rider through the baseplate and to the board, and a boot engagement system such as one or more straps for securing the boot in the binding. Another type of binding, known as a step-in binding, also includes a baseplate and a highback (or the highback may be provided on the step-in binding boot), but does not employ a strap system. Rather, a step-in binding is characterized by one or more strapless engagement members which lock the boot into the binding. In such step-in systems, a handle or lever may be actuated to move one of the engagement members into and out of engagement with the snowboard boot or, instead, the engagement member may be automatically actuated upon stepping of the rider stepping into the binding. With either the tray or the step-in bindings, flexing of a rider's legs and a shifting in weight and balance, induces forces through the engagement members and/or the highback, through the baseplate and to the board, allowing the rider to control and maneuver the board along the terrain.

It is known that force transmission and the "feel" of a ride are dependent, in part, on certain properties of the binding baseplate. The responsiveness of a binding to movement of the rider generally increases as the binding becomes stiffer. Certain riders interested in enhanced power transmission and fast board control may prefer such a stiffer baseplate. On the other hand, a more flexible baseplate may be desirable to enhance the feedback or feel of the rider as she courses down a slope. To such riders interested in feel and comfort, the ability to "roll" her foot within the binding and against the straps or other boot engagement members, without immediately having the board shift on edge or otherwise respond, may be important. In addition, a stiff baseplate may more readily transmit shock from the board to the rider, while a more flexible baseplate tends to absorb shock and chatter for a more comfortable and, perhaps, more forgiving ride.

Binding baseplates are typically manufactured from a single material, dictating a particular performance property characterized by the stiffness of the baseplate. Some baseplates have been provided that include separate components with different stiffness properties, such as a metal or plastic base that is coupled to a stiffer metal heel hoop that supports a highback and an ankle strap. These baseplates, however, do not allow for selective adjustment of the stiffness of the binding and therefore do not allow a rider to vary the performance properties of the binding which may be desirable. Further, certain riders may desire a baseplate with a hybrid or a balance between these sometimes competing performance properties. That is, a binding that provides good power transmission and control yet also is characterized by a good feel and flexible response to rider induced forces.

SUMMARY OF THE INVENTION

The present invention is therefore directed to a snowboard binding apparatus which overcomes the above-noted and other disadvantages of prior snowboard binding apparatuses. The present invention results in a snowboard binding having a baseplate with a toe end, a heel end, a lateral sidewall, and a medial sidewall. The baseplate is constructed and arranged to support a snowboard boot. The baseplate includes at least one location along each of the lateral and medial sidewalls for mounting at least one boot engagement member. The flexibility, in response to forces generated by a rider against the boot engagement member, of at least one mounting location along at least one of the medial and the lateral sides is selectively adjustable by a rider.

In an illustrative embodiment of the invention, a snowboard binding is disclosed. The snowboard binding includes a base which has a toe end, a heel end, a lateral side, and a medial side. The base is constructed and arranged to support a snowboard boot. The binding also includes at least one mount supported by the base. The mount is suitable for mounting at least one boot engagement member. At least one mount is subject to flexing in response to rider induced forces acting on the boot engagement member. The binding further includes a system supported by the binding for selectively adjusting the flex response of the mount to rider induced forces acting on the boot engagement member.

In another illustrative embodiment of the invention, a snowboard binding is disclosed. The snowboard includes a base having a toe end, a heel end, a lateral side, and a medial side. The base is formed from a material having a first stiffness. The binding also includes a mount for supporting a boot engagement member which holds down the front of a rider's foot. The mount is formed of a second material having a second stiffness which is different from the first stiffness.

In still another illustrative embodiment of the invention, a snowboard binding is provided. The snowboard binding includes a baseplate having a toe end, a heel end, a lateral sidewall, and a medial sidewall. The baseplate is also constructed and arranged to receive a snowboard boot. The binding also includes a boot engagement member mount adapted to receive a boot engagement member fixed to at least one of the lateral and medial sidewalls at a location proximate to the toe end and a location proximate to the heel end of the baseplate. The binding further includes at least one stiffener insert. The stiffener insert is placed between the toe end and the heel end fixation locations. The stiffener inserts allow the rider to adjust the flexing of the boot engagement member mount to rider induced forces acting on the boot engagement member.

In one embodiment of the invention, a snowboard binding is provided. The snowboard binding includes a baseplate having a medial side and a lateral side. The binding also includes a mount which is attached to the baseplate on at least one of the medial side and the lateral side. The binding also includes means for adjusting the flexibility of the mount in response to rider induced forces acting on the mount.

In another illustrative embodiment of the invention, a snowboard binding is provided. The binding includes a baseplate constructed and arranged to secure a snowboard boot to the snowboard. The baseplate has a flexibility that is selectively adjustable between a first fixed stiffness and a second fixed stiffness. In addition, the first stiffness is different from the second stiffness.

In still another illustrative embodiment of the invention, a method for selectively adjusting the stiffness of a snowboard binding is provided. The method includes the steps of providing a binding adapted to attain one of a plurality of stiffnesses and reversibly adjusting the stiffness between the plurality of stiffnesses such that the stiffness may be changed from a first stiffness to a second stiffness and then to the first stiffness.

Various embodiments of the present invention provide certain advantages and overcome certain drawbacks of the conventional techniques. Not all embodiments of the invention share the same advantages and those that do may not share them under all circumstances. This being said, the present invention provides numerous advantages including the noted advantage of providing variable flexibility and cost of the baseplate and adjustability of the binding responsiveness.

Further features and advantages of the present invention, as well as the structure and operation of various embodiments of the present invention, will become apparent from the following detailed description when taken in connection with reference to the accompanying drawings.

BRIEF DESCRIPTION OF THE DRAWINGS

The invention will now be described, by way of example, with reference to the accompanying drawings, in which.

DETAILED DESCRIPTION

Figure 1:
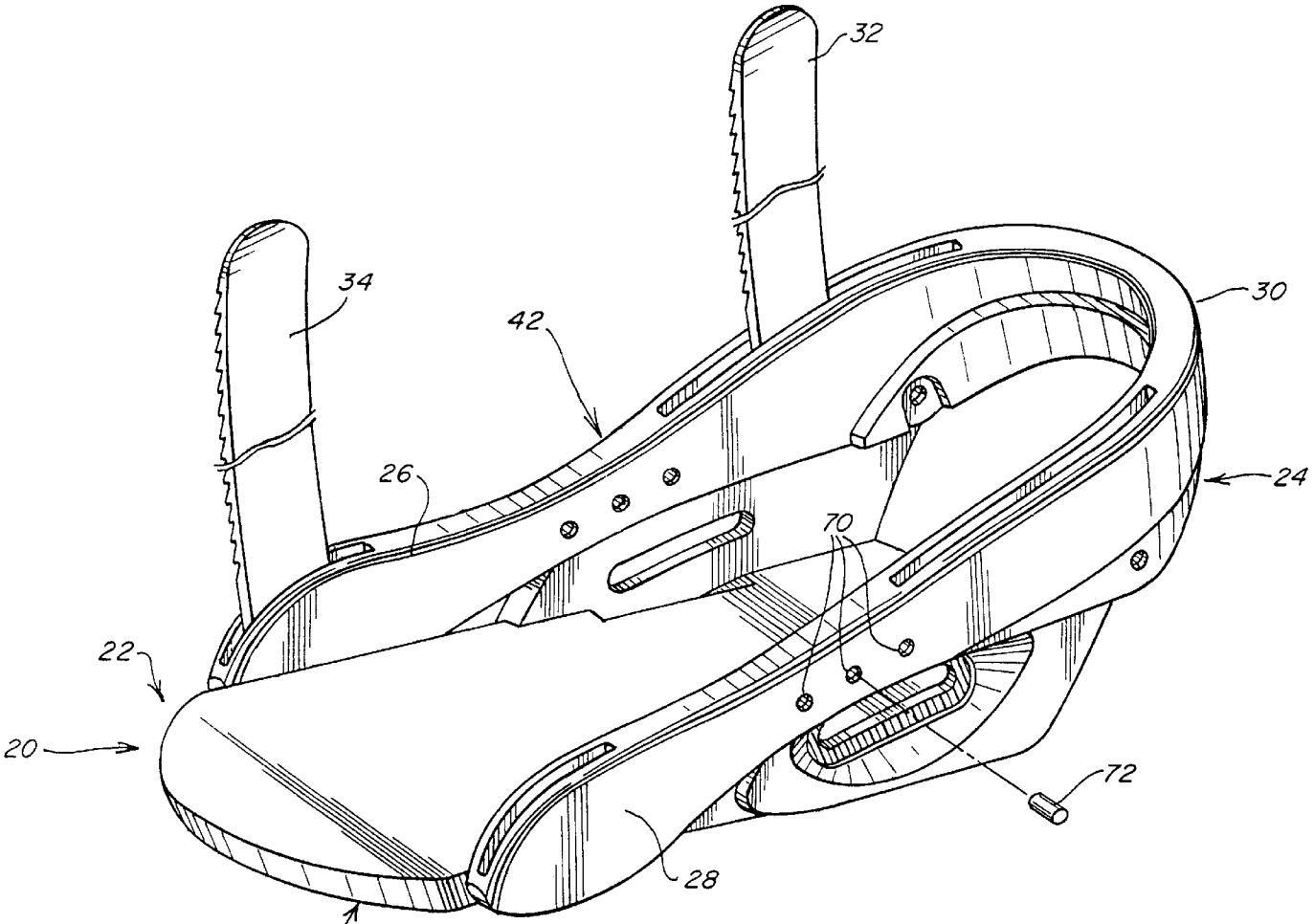
FIG. 1 is a perspective view of a snowboard binding according to one illustrative embodiment of the invention.

The present invention is a baseplate for binding a foot to a board, and is particularly suitable for application as a snowboard binding baseplate. The binding baseplate may be tuned to provide a certain level and/or balance of one or more performance properties including, but not limited to power transmission, responsiveness, feel, and comfort. Accordingly, the binding baseplate may include localized regions of varying stiffness to provide a specific performance property. Consequently, the binding baseplate may include a specific stiffness characteristic at a location where the boot engagement members are mounted, providing a desired response of the binding baseplate to pulling forces that may be generated by the rider as she induces forces into the boot engagement members during turns, landing jumps, and otherwise during riding. Thus, in one embodiment, the give or flex of the binding, in response to the drawing force of the straps may be limited by stiffening the sidewall, so that there is little play, ensuring that the force of the rider's leg and foot movements are transmitted directly to the edge of the board. In another embodiment, the binding may be tuned so that the sidewalls provide more give and flex in response to rider induced forces on the boot engaging straps, enhancing the feel of the rider, for example, as she rolls her foot against the strap while initiating and then leaning into a turn.

It also is contemplated that tuning the stiffness of a binding baseplate will influence the performance of heel side and toe side turns. In a heel side turn, the rider controls the snowboard by applying force through the boot, along the highback and directly into the baseplate typically through the cooperation of a forward lean adjuster mounted on the highback and the baseplate heel hoop against which it seats, and subsequently into the board. Heel side turning also may be influenced by the lifting forces of the boot against a toe strap or other boot engagement member that is arranged to provide hold down of the front of the foot. Consequently, force transmission on a heel side turn may be varied by manipulating the stiffness property of the heel hoop, and the mounting location of the heel hold down boot engagement member (i.e., ankle strap for a tray binding) as well as the mounting location for the toe end boot engagement member (i.e., toe strap for a tray binding). An increase in stiffness at one or more of these locations is believed to increase the responsiveness of the baseplate in heel side turns. For toe side turns, a rider pivots her boot upwarldy about the ball of the foot, driving her boot against the ankle strap or other boot engagement member employed for heel hold down. The response of the baseplate, here also, is affected by the stiffness of the baseplate where the ankle strap or other heel hold down arrangement is mounted. Again, by making stiffer the portion of the baseplate where the rider induced forces are first generated or conducted, is believed to promote quicker and more efficient power transmission to the board edge. Further, the overall stiffness profile of the baseplate will be affected by such localized tuning of stiffness properties which, too, will influence how the binding baseplate responds to rider induced forces.

It should be noted that the term "stiffness" as used herein indicates a force-distance property curve associated with a particular material and/or a structural element, and the term "flexibility" is used herein indicates a response of a particular material or a structural element to an applied force, e.g., a material of a particular stiffness flexes in response to an applied force. Stiffness of a binding baseplate component may be varied by altering the materials forming the component, the processes used to form the component, and any post processing treatments, and by the design of the component.

Figure 2:
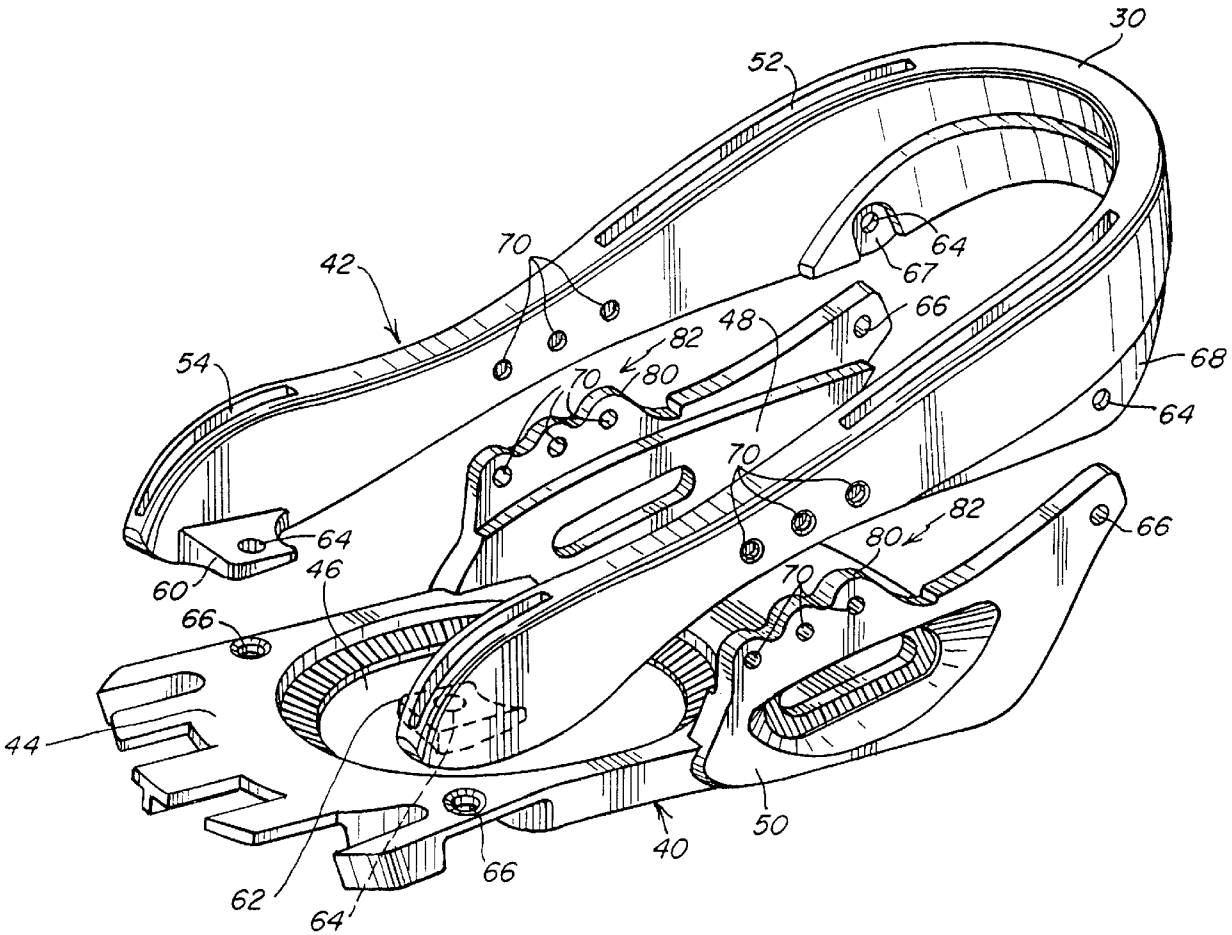
FIG. 2 is an exploded perspective view of a snowboard binding of FIG. 1.

An illustrative embodiment of the invention is illustrated in FIGS. 1 and 2 and includes a baseplate 20 having a toe end 22, a heel end 24, a lateral sidewall 26, and a medial sidewall 28. A heel hoop 30 may be provided at the rear of the binding baseplate 20 which is arranged to receive the back portion of a rider's boot (not shown). A highback (not shown) may be mounted to the baseplate 20 or the heel hoop 30 and may include a forward lean adjuster for setting a desired angle of the highback. The forward lean adjuster may seat against the heel hoop 30, and may be locked in the seated arrangement if desired by appropriate linkage (not shown), to provide force transmission from the highback to the baseplate 20. One or more boot engagement members may be mounted to the binding, in the illustrated embodiment there are mounting locations for an ankle strap 32 and a toe strap 34. However, the particular number or arrangement of binding straps, or the selection of the type of boot engagement member (other strap configurations or step-in binding boot engagement constructions), is not critical to the invention here disclosed, and that the specific strap arrangement and mounting location therefore is provided merely for illustrative purposes, and the present invention is not limited to this or any particular boot engagement arrangement. Thus, the binding baseplate may also be implemented as a step-in snowboard binding where a locking mechanism directly or indirectly engages with complementary features on a snowboard boot and, thus, a boot engagement member may include, but is not limited to, a step-in type locking mechanism.

The binding baseplate 20 may be formed with regions of varying stiffness. To address flex, the stiffness of the sidewalls 26, 28 of the baseplate 20 may be increased or lessened with respect to other regions of the baseplate 20 such as the lower base portion, although other points of reference in the baseplate 20 may similarly be employed. To encourage toe edge turning, the mount location for the illustrated ankle strap 32 is stiffer than other regions of the baseplate 20, again as an example the ankle strap mount may be stiffer than the bottom region of the baseplate 20. For heel side response, the principal force is induced through the highback and into the heel hoop 30, so providing a stiff heel hoop, as compared to the bottom or other region of the baseplate, will enhance that board maneuver. Although the illustrated baseplate includes localized variations in stiffness to achieve a desired property of lateral and medial flex, heel side response and toe side response, any one or more of the properties described, and other performance properties not discussed, may be targeted with the present invention.

The binding baseplate 20 may be formed in a variety of manners to achieve the desired performance tuning. The baseplate 20 may be composed of a single material, but due to manufacturing processing or post fabrication treatment localized regions of the baseplate 20 may have different stiffness or other physical properties. Alternatively, the baseplate 20 may be formed of two or more different materials; by different materials, it is meant that materials having different chemical compositions or like materials that have been processed differently or otherwise transformed so that the two similarly composed materials are nonetheless characterized by at least one physical or mechanical property by which they differ.

As illustrated, the binding baseplate 20 is formed of two components, a base 40 and a boot engagement member mount 42, which may be substantially U-shaped. The base 40 includes a floor 44 that is arranged for mounting to a snowboard and may be provided with an aperture 46 for receiving a hold down disc (not shown) in the well known manner for securing the baseplate via fasteners extending through holes in the disc that are threaded into inserts provided in the snowboard. The base 40 includes a lateral sidewall 48 and a medial sidewall 50 that are arranged to connect with the boot engagement member mount 42. The mount 42 may include a heel hoop 30. The mount 42 may include a location 52 for mounting a boot engagement member for holding down the rider's heel, such as the ankle strap 32. A mounting location 54 also is provided for the toe end strap 34 for restraining the front of the rider's foot. As illustrated, the mounting structure for the boot engagement straps are slots that receive a strap provided with an enlarged end that is prevented from passing through the slot. Tightening down respective strap pairs with a ratchet type buckle or other locking mechanism (not shown), draws the enlarged ends against the baseplate, securing straps and the encompassed boot within the binding. The present invention is not limited to this arrangement for mounting a strap to a baseplate and the use of fasteners inserted through an opening in the strap that passes through a compatible hole is the baseplate sidewall where it is secured by a nut or other fastener is contemplated as would be other arrangements that are apparent to one of skill in the art. Notably, again, the binding baseplate is not limited to strap bindings and a mount for a step-in or other arrangement for securing a boot to a binding also is within the present invention. The mount and heel hoop component 42 has a stiffness greater than or less than the stiffness of the base 40.

The boot engagement member mount 42 and/or base 40 maybe formed of any suitable material such as PVC, glass-filled nylon, or other fiber-filled materials, or any metals. Variation in the size, length, and make-up of the fiber and/or the matrix composition and properties, may be applied to change the stiffness of these materials and the base and mount formed thereby. Further, the same material may be used for both the base 40 and the mount 42 with the difference in stiffness between the two components being due to a variation in the fiber employed or, perhaps, fabrication and/or post processing treatments. While several examples of materials and fabrication have been described above, it is to be appreciated that the baseplate may be fabricated with any suitable manufacturing process and/or material as would be apparent to one of skill in the art. Although the binding baseplate has been described where the boot engagement member mount 42 is stiffer than the base 40, the invention also contemplates having the baseplate stiffer than the boot engagement member mount. Similarly, the mount for the boot engagement member directed to heel hold down may be stiffer than the mount for the boot engagement member directed to holding down the front of the rider's foot, or may be less stiff or may have the same stiffness, depending upon the desired performance properties of the binding baseplate or other factors including ease of manufacturing and conservation of product cost.

In those embodiments where the baseplate is formed from more than one component, the various elements, such as the base 40, boot engagement member mount 42 and, if separate from the latter component, then also the heel hoop 30, are joined together by attachment elements. These junctions may be permanent or may by detachable allowing a rider to remove and either repair or replace a component. Further, by providing a removable component, the stiffness of the baseplate 20 may be varied by replacing an existing component with a new component having a different physical property. Those skilled in the art will recognize that many attachment devices, including but not limited to, bolts, screws, rivets, cam attachment devices, and pins, may be employed as attachment devices to attach the mount 42 to the base 40. The components may also be permanently connected through adhesive, thermal fusion, ultrasonic welding, by molding the components together whether by insert molding or otherwise, and by other arrangements and techniques as would be apparent to one of skill in the art.

As illustrated in the FIGS. 1–2, the mount 42 includes a pair of flanges 67, 68 with holes 64 that are registrable with complementary holes 66 in the base 40 which may be secured by a fastener (not shown) such as a screw or the like. Similar constructs 60, 62 for receiving a fastener are provided at the toe end of the baseplate, securing the mount 42 and base 40 there as well. Although a pair of attachment locations are employed in the described embodiment at each of the toe and heel ends, the invention is not so limited and any number and arrangement of attachment junctions may be employed as would be apparent to one of skill in the art. The baseplate may be configured so that one or more attachment locations are positioned near a boot engagement member mount to enhance force transmission when a rider acts against the strap or other boot engagement member. As illustrated, the attachment devices 60, 62, 67, 68 are located directly below the strap attachment locations 52, 54 on the mount 42, so that the straps transmit force into the mount and directly into the base as the moment arm from the strap attachment location and the mount and base attachment location is reduced. Conversely, as the attachment devices are moved away from the strap attachment locations, the moment arm increases and force transmission is reduced. Not all of the attachment locations need be proximate a boot engagement mount in order for the noted benefits to occur.

The binding baseplate 20 may be constructed and arranged so that the stiffness of localized regions and/or the entire stiffness profile of the baseplate 20 may be selectively adjusted by the rider. As shown in FIG. 1, the baseplate 20 may be arranged with any suitably shaped openings or recesses 70 that are adapted to receive stiffener inserts 72. By selectively placing the stiffener inserts 72 into such openings, the localized and overall stiffness of the baseplate may be changed. The size and/or shape of the apertures and opening may depend upon the desired stiffness range. Also, the stiffener inserts 72 may be provided in a range of stiffener affecting properties so that a different insert having a different influence on the stiffness properties of the baseplate may be selectively inserted into a single, specific aperture by a rider. Further, the stiffness of a region may be increased or decreased by varying the thickness or surface texture of the baseplate at selected locations. The stiffness may also be established using various structural members or reliefs, such as ribs or grooves.

Since the degree of baseplate stiffness is a matter of individual rider preference, it is desirable that a rider be provided the option of selectively adjusting the stiffness of the baseplate. The stiffener inserts 72, that also may be referred to as control elements, are preferably removable so that a rider can readily adjust the overall baseplate stiffness by interchanging several control elements of varying stiffness. In one illustrative embodiment, the stiffener inserts 72 are detachable plugs that may be locked into and removed from the apertures 70. Each plug may include an interlock, such as a barb, a tooth, an undercut or the like, that engages a corresponding feature, such as the periphery of the aperture, to retain the plug in the baseplate during anticipated riding conditions. The baseplate may be provided with two or more plugs of any suitable shape having different stiffness characteristics for each aperture to give a rider several options for baseplate stiffness. The stiffener insert 72 may take the form of a plug or panel insert on the sidewall.

So, at one extreme, the baseplate stiffness may be minimized by removing each of the stiffener inserts 72 so that the baseplate may flex unconstrained. At the opposite extreme, baseplate stiffness may be maximized by utilizing very stiff inserts 72 and ensuring that no openings are left vacant. The latter arrangement would appear suitable where high power transmission and quick board response is desired. Intermediate levels of baseplate stiffness may be achieved by plugging only some, but not all, of the openings.

Stiffening can also be implemented by selective mechanical connection between the boot engagement member mount and the base. As illustrated in FIG. 2, the mount 42 and the base 40 define a stiffening section 82. The stiffening section includes a projection or pedestal 80 on the base 40 which has an interface surface that cooperates with a corresponding interface surface on the mount 42. In the illustrated embodiment, the base projection 80 is configured as a tongue that is received within a groove in a sidewall of the mount 42. One or more apertures 70 extend through the tongue and the sidewall defining the groove, allowing a fastener or stiffener insert to be inserted therethrough. The stiffness of the baseplate and, consequently the response of the baseplate to various rider induced forces, may then be adjusted selectively by the rider. Where more than one set of complementary apertures are provided, a particular relative stiffness may be obtained by selecting a specific aperture as compared to another. And stiffness may be further enhanced by applying a mechanical fastener or stiffener insert into more than one of the registered sets of apertures. Although a single tongue and groove configuration is illustrated, multiple tongue and groove stations may as would be apparent to one of skill in the art. Further, the mechanical fixation of the mount 42 to the base 40 is not limited to a fastener and aperture arrangement, and other mechanisms and designs are well suited to the present invention as would be apparent to one of skill in the art.

The use of stiffener inserts and/or mechanical fixation of the mount to the base allows the rider to adjust the stiffness of the binding to control one or more of lateral and medial flexing, toe side response, and heel side response. In this respect, the rider may add or remove all or some of the stiffener inserts and/or mechanical fixation (whether all on one side or both sides) from the binding baseplate to selectively adjust the stiffness of the binding as desired. In one example, the rider may prefer a more flexible medial side, and thus remove all stiffener inserts from the medial side of the mount and base. In addition, the rider may increase the stiffness of the lateral side of the binding by inserting one or more stiffener inserts into the appropriate apertures. Combinations of various stiffener inserts of similar or differing properties in the apertures may also be employed to further adjust the flexibility in accordance with the rider's preferences.

The stiffening section may be placed on the lateral and/or medial side of the base and mount between the toe end and the heel end fixation locations of the base 40 and the mount 42. In one embodiment, the stiffening section is placed substantially near the middle of the length of the binding, e.g., near the hold down disk of baseplate.

Having thus described certain embodiments of the present invention, various alterations, modifications, and improvements will readily occur to those skilled in the art. Such alterations, modifications, and improvements are intended to be within the scope of the invention. Accordingly, the foregoing description is by way of example only, and not intended to be limiting. The invention is limited only as defined in the following claims and the equivalents thereof.

What is claimed is:

1. A snowboard binding for mounting a boot to a snowboard, the snowboard binding comprising:

a baseplate assembly having a baseplate portion configured for attachment to the snowboard, a toe end, a heel end, a lateral sidewall, and a medial sidewall, the baseplate assembly constructed and arranged to support the snowboard boot; and at least one boot engagement member adapted to hold at least a portion of the boot to the baseplate assembly;

wherein at least one of the medial and the lateral sidewalls has a flexing portion, wherein the flexing portion has at least one mounting location for mounting the at least one boot engagement member, wherein the flexing portion flexes in relation to the baseplate portion, in response to forces generated by a rider on the boot engagement member, and wherein the flex of the flexing portion is selectively adjustable by a rider.

2. The binding as claimed in claim 1, wherein the at least one boot engagement member is a strap.

3. The binding as claimed in claim 1, wherein the at least one boot engagement member is a strapless engagement member.

4. The binding as claimed in claim 1, wherein the baseplate portion is formed of a first material having a first stiffness and the flexing portion is formed of a second material having a second stiffness.

5. The binding as claimed in claim 4, wherein the baseplate portion and the flexing portion are removably attached to each other.

6. The binding as claimed in claim 1, further comprising at least one aperture formed in the flexing portion and at least one aperture formed in the baseplate assembly suitable for placement of at least one stiffener insert, wherein the at least one aperture in the flexing portion and the at least one aperture in the baseplate assembly are in registration with each other.

7. The binding as claimed in claim 6, wherein at least one stiffener insert removably attaches the baseplate portion to the flexing portion.

8. The binding as claimed in claim 1, further comprising at least one aperture formed in the flexing portion and at least one aperture formed in the baseplate assembly suitable for placement of at least one fastener, wherein the at least one aperture in the flexing portion and the at least one aperture in the baseplate assembly are in registration with each other.

9. The binding as claimed in claim 1, wherein the baseplate assembly comprises an interface surface for cooperating with a corresponding interface surface on the flexing portion.

10. The binding as claimed in claim 9, wherein the flexing portion is nested to the baseplate assembly.

11. The binding as claimed in claim 9, wherein the interface surfaces comprise at least one tongue and groove construction.

12. The binding as claimed in claim 1, wherein the flexing portion includes a substantially U-shaped member having a first end forming at least a portion of a heel hoop and a second end extending substantially towards the toe end of the baseplate assembly.

13. The binding as claimed in claim 12, wherein the first end includes a means for attaching the U-shaped member to the baseplate assembly and wherein the second end includes a means for attaching the U-shaped member to the baseplate assembly substantially at the toe end of the baseplate.

14. A snowboard binding for mounting a boot to a snowboard, the snowboard binding comprising:

a baseplate having a toe end and a heel end, the baseplate being constructed and arranged to support the snowboard boot;

a boot engagement member adapted to hold at least a portion of the boot to the baseplate;

a mount mounting the boot engagement member to the baseplate, the mount being supported by the baseplate proximate the toe end and the heel end of the baseplate, a portion of the mount flexing in relation to a portion of the baseplate in response to rider induced forces acting on the boot engagement member; and a system supported by the binding for selectively adjusting the flexing of the portion of the mount to rider induced forces acting on the boot engagement member.

15. The binding as claimed in claim 14, wherein the boot engagement member is a strap.

16. The binding as claimed in claim 14, wherein the boot engagement member is a strapless engagement member.

17. The binding as claimed in claim 14, wherein the baseplate includes a lateral sidewall and a medial sidewall supporting the mount.

18. The binding as claimed in claim 14, wherein the mount includes a lateral sidewall and a medial sidewall.

19. The binding as claimed in claim 14, wherein the baseplate is formed of a first material having a first stiffness and wherein the mount is formed of a second material having a second stiffness.

20. The binding as claimed in claim 14, wherein the baseplate and the mount are removably attached to each other.

21. The binding as claimed in claim 14, wherein the system for selectively adjusting the flexing includes at least one aperture in the mount and at least one aperture in the baseplate suitable for placement of at least one stiffener insert, wherein the at least one aperture in the mount and the at least one aperture in the baseplate are in registration with each other.

22. The binding as claimed in claim 21, further comprising at least one stiffener insert adapted for insertion into the at least one aperture in the mount and the at least one aperture in the baseplate.

23. The binding as claimed in claim 21, further comprising at least one fastener adapted for fastening the mount to the baseplate through the at least one aperture in the mount and the at least one aperture in the baseplate.

24. The binding as claimed in claim 14, wherein the baseplate and the mount are integrally molded together.

25. The binding as claimed in claim 24, wherein the system for selectively adjusting the flexing includes at least one aperture in the mount and at least one aperture in the baseplate suitable for placement of at least one stiffener insert, wherein the at least one aperture in the mount and the at least one aperture in the baseplate are in registration with each other.

26. The binding as claimed in claim 14, wherein the mount is a substantially U-shaped member having a first end forming at least a portion of a heel hoop and a second end extending substantially towards the toe end of the baseplate.

27. The binding as claimed in claim 26, wherein the first end includes a means for attaching the mount to the baseplate and wherein the second end includes a means for attaching the mount to the baseplate substantially at the toe end of the baseplate.

28. A snowboard binding for mounting a boot to a snowboard, the snowboard binding comprising:

a baseplate including a toe end, a heel end, a lateral sidewall, and a medial sidewall, the baseplate being constructed and arranged to receive the snowboard boot;

at least one boot engagement member adapted to hold at least a portion of the boot to the baseplate;

a boot engagement member mount coupling the boot engagement member to the baseplate, the mount being fixed to the baseplate at a fixation location proximate to the toe end and at a fixation location proximate to the heel end, the mount having a flexing portion between the toe end and the heel end fixation locations subject to flexing in relation to a portion of the baseplate in response to forces acting on the boot engagement member and imposed on the flexing portion; and at least one stiffener insert with which a rider may insert into the binding between the toe end and the heel end fixation locations to allow the rider to adjust the flexing of the flexing portion of the mount in response to rider induced forces acting on the boot engagement member and imposed on the flexing portion subject to flexing.

29. The binding as claimed in claim 28, wherein the boot engagement member is a strap.

30. The binding as claimed in claim 28, wherein the baseplate and the mount are removably attached to each other.

31. The binding as claimed in claim 28, further comprising at least one aperture in the flexing portion of the mount and at least one aperture in the baseplate suitable for placement of at least one stiffener insert, wherein the at least one aperture in the flexing portion and the at least one aperture in the baseplate are in registration with each other.

32. The binding as claimed in claim 31, wherein at least one stiffener insert removably attaches the baseplate to the mount.

33. The binding as claimed in claim 28, further comprising at least one aperture in the flexing portion of the mount and at least one aperture in the baseplate suitable for placement of at least one fastener, wherein the at least one aperture in the flexing portion of the mount and the at least one aperture in the baseplate are in registration with each other.

34. The binding as claimed in claim 3, wherein the baseplate comprises an interface surface for cooperating with a corresponding interface surface on the flexing portion of the mount.

35. The binding as claimed in claim 34, wherein the mount is nested to the baseplate.

36. The binding as claimed in claim 34, wherein the interface surfaces comprise at least one tongue and groove construction.

37. The binding as claimed in claim 28, wherein the mount is a substantially U-shaped member having a first end forming at least a portion of a heel hoop and a second end extending substantially towards the toe end of the baseplate.

38. A method for reversibly adjusting the flexibility of a snowboard binding, comprising the acts of:

providing a binding having a baseplate, a mount supported by the baseplate, and a boot engagement member attached to the mount, the mount having a deflection portion capable of deflecting with respect to the baseplate in response to rider induced forces imposed on the boot engagement member and the deflection portion, the deflection portion having a characteristic which is selectively adjustable, the characteristic being an amount of deflection of the deflection portion;

adjusting the amount of deflection of the deflection portion from a first amount to a second amount; and adjusting the amount of deflection of the deflection portion from the second amount to the first amount.

39. A snowboard binding for mounting a boot to a snowboard, the snowboard binding comprising:

a baseplate assembly having a planar portion configured for attachment to the snowboard, a toe end, a heel end, a lateral sidewall, and a medial sidewall, the lateral and medial sidewalls extending upwardly from the planar portion, the baseplate assembly constructed and arranged to support the snowboard boot; and at least one boot engagement member adapted to hold at least a portion of the boot to the baseplate;

wherein at least one of the medial and lateral sidewalls having an upper portion attached to a lower portion at longitudinally spaced attachment points, the upper portion including a flexing portion extending between the attachment points, the baseplate assembly having at least one mounting location along each of the lateral and medial sidewalls for mounting the at least one boot engagement member, at least one of the mounting locations is on the flexing portion of the at least one of the medial and lateral sidewalls, the flexing portion flexing in relation to the lower portion of the respective sidewall in response to forces generated by a rider on the at least one boot engagement member, and wherein a flexibility of the flexing portion is selectively adjustable by the rider.

* * * * *